US005445682A

United States Patent [19]

Hasegawa et al.

[11] Patent Number: 5,445,682

[45] Date of Patent: Aug. 29, 1995

[54] METHOD OF APPLYING SURFACE HYDROPHILIC TREATMENT TO HEAT-TRANSFER TUBE

[75] Inventors: Naoyuki Hasegawa, Hatano; Seiji Ishida, Tokyo; Hisanori Shiraishi, Hatano, all of Japan

[73] Assignee: Kabushiki Kaisha Kobe Seiko Sho, Kobe, Japan

[21] Appl. No.: 271,636

[22] Filed: Jul. 7, 1994

[30] Foreign Application Priority Data

Jul. 7, 1993 [JP] Japan ..... 5-192801
Jul. 7, 1993 [JP] Japan ..... 5-192802

[51] Int. Cl.[6] ..... C21D 3/02; F28F 21/08

[52] U.S. Cl. ..... 148/241; 148/269; 165/133; 29/890.053; 427/539

[58] Field of Search ..... 148/241, 269; 165/133; 29/890.53; 427/539

[56] References Cited

U.S. PATENT DOCUMENTS 5,009,962 4/1991 Yamasoe ..... 165/133

*Primary Examiner*—Sam Silverberg
*Attorney, Agent, or Firm*—Oblon, Spivak, McClelland, Maier & Neustadt

[57] ABSTRACT

A method of applying a surface hydrophilic treatment to a heat-transfer tube with a good productivity, which obtains an excellent surface hydrophilic property not deteriorated for a long term. The method includes the steps of: heating a copper or copper alloy heat-transfer tube for 5 to 10 min at a temperature ranging from 250° to 350° C. in an atmosphere mainly containing an inert gas; and applying corona discharge or plasma discharge to the copper or copper alloy heat-transfer tube. To prevent the coloring, the atmosphere preferably contains $O_2$ in a concentration of 3% or less and CO in a concentration of 1 to 5%, the balance being an inert gas.

2 Claims, 5 Drawing Sheets

METHOD OF APPLYING SURFACE HYDROPHILIC TREATMENT TO HEAT-TRANSFER TUBE

BACKGROUND OF THE INVENTION

1. Field of the Invention

The present invention relates to a method of improving the surface hydrophilic property of a copper or copper alloy made heat-transfer tube which is formed in a specified tube shape and is used for heat exchangers, and particularly to a method of applying a surface hydrophilic treatment on the surface of a metal heat-transfer tube by plasma discharge or corona discharge.

2. Description of the Related Art

Methods of improving the surface hydrophilic property of a metal heat-transfer tube used for heat exchangers have been known as follows:

(1) Mechanical Grinding

This involves degreasing and cleaning a copper or copper alloy heat-transfer tube by solvent or the like, and grinding the surface of the pipe by a wire brush or sand paper for removing organic matters adhering on the surface of the tube, such as drawing oil, rolling oil and cutting oil, thereby improving the surface hydrophilic property.

(2) Surface Chemical Treatment

This involves cleaning and activating the surface of a heat-transfer pipe by sulfuric acid or surface-active agent, thereby improving the surface hydrophilic property.

(3) Heat-treatment

This involves heat-treating a copper or copper alloy heat-transfer tube for evaporating and separating organic matters adhering on the surface of the pipe, such as drawing oil, rolling oil and cutting oil, thereby improving the surface hydrophilic property.

Either of the above-described prior art methods succeeds to obtain a surface hydrophilic property somewhat, but not sufficiently, and it has the following disadvantages.

In the mechanical grinding, a good hydrophilic property can be obtained directly after the grinding; however, since a copper or copper alloy heat-transfer surface exposed by the grinding is active and is easily affected by the environmental atmosphere, it is stuck with contaminations and is deteriorated in its hydrophilic property with age. In terms of environmental sanitation, the cleaning by an organic solvent causes a problem, for example, solvent exerts adverse effect on a human body.

The surface chemical treatment requires equipment for acid cleaning and water treatment, resulting in the increased maintenance cost. This treatment generally takes a lot of time, with a result of poor productivity. Like the mechanical grinding, this treatment can obtain a good surface hydrophilic property directly after the treatment; however, the hydrophilic property thus obtained is deteriorated with age.

In the heat-treatment method, the surface of a copper or copper alloy must be heated up to a decomposition temperature (usually, 300° C. or more) of a working oil and is kept at the temperature until the surface of the tube is cleaned. However, for a copper pipe generally used for the heat-transfer tube, when the heating time higher than the softening temperature of the copper becomes longer to obtain a hydrophilic property, the copper tube is reduced in its mechanical strength. In addition, to prevent the softening due to heating, there is known a flame treatment in which only the surface of a copper or copper alloy tube is locally heated by flame. In this flame treatment, however, it is difficult to treat the tube without any softening while uniformly exposing the whole periphery of the pipe to flame, thereby tending to generate the unevenness.

The flame treatment has another disadvantage. In this treatment, not only the outer surface but also the inner surface of the pipe is colored by heating performed in the atmospheric air. In a water heat exchanger in which water passes through a pipe, the colored portion within the pipe tends to be corroded, thereby generating a trouble such as leakage.

SUMMARY OF THE INVENTION

An object of the present invention is to provide a method of applying a surface hydrophilic treatment to a heat-transfer tube with a good productivity, which is capable of obtaining an excellent surface hydrophilic property not deteriorated for a long term.

To achieve the above object, according to the present invention, there is provided a method of applying a surface hydrophilic treatment to a copper or copper alloy heat-transfer tube, including the steps of: heating a copper or copper alloy heat-transfer pipe for 5 to 10 min at a temperature ranging from 250° to 350° C. in an atmosphere mainly containing an inert gas; and then applying corona discharge or plasma discharge to the copper or copper alloy heat-transfer tube.

DETAILED DESCRIPTION OF THE PREFERRED EMBODIMENTS

Figure 1:
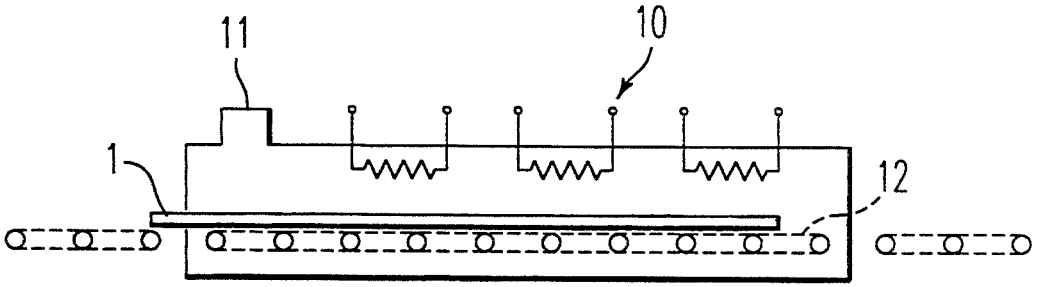
FIG. 1 is a view of assistance in explaining a heating apparatus.

Hereinafter, the present invention will be described in detail with reference to the drawings.

In the present invention, first, a copper or copper alloy pipe is heated for 5 to 10 min at a temperature ranging from 250° to 350° C. in an atmosphere mainly containing an inert gas. The heating evaporates and separates oil content on the surface of the tube to a certain degree.

The reason why the above atmosphere is mainly composed of an inert gas such as $N_2$ is to prevent the coloring upon evaporating and separating oil content on the surface of the pipe. The atmosphere preferably has the following gas composition.

Namely, it preferably contains $O_2$ in a concentration of 3% or less and CO in a concentration of 1 to 5%, the balance being an inert gas such as $N_2$. When the $O_2$ concentration is more than 3%, the coloring is easily generated on the inner and outer surfaces of the pipe, which causes a fear that the colored portions are corroded, in the case of a water heat exchange in which water passes through the tube. When the CO concentration is more than 5%, the surface of a heat-transfer tube is activated by the reducing action thereof, and is colored by the absorption of water; while when it is less than 1%, oxygen in the atmosphere is not perfectly reduced, tending to generate the oxidation and coloring.

The gas composition is desirable not to contain $H_2$, but it is permissible to contain 4% or less. When the $H_2$ content is more than 4%, there is a fear of generation of explosion due to heating.

When the heating temperature is lower than 250° C., the removing efficiency of oil content on the surface of a tube becomes lower; while, when it is more than 350° C., copper generally used for a heat-transfer tube is softened. When the heating time is less than 5 min, the removing efficiency of organic matters becomes lower; while when it is more than 10 min, the strength of the tube is reduced and the productivity is made poor. The heating temperature is thus specified to be in the range from 250° to 350° C., and the heating time is specified to be in the range from 5 to 10 min.

The residual organic matters such as oil content on the surface of the tube can be somewhat separated by the heating in the above atmosphere, but in this stage, the hydrophilic property thus obtained is insufficient.

To obtain a good hydrophilic property less in deterioration with age, after the above heat treatment, the copper or copper alloy heat-transfer tube is subjected to corona discharge or plasma discharge. The treatment by corona discharge will be described below. In addition, the same effect can be obtained by the treatment by plasma discharge.

In the treatment by corona discharge, a voltage is applied across the heat-transfer tube already heat-treated and an electrode separated from the surface of the tube by a specified distance, to generate a corona discharge. The corona discharge allows electrons to collide with the surface of the tube. The residual organic matters, which are not sufficiently removed only by the heating treatment, are separated and reduced due to the collision of electrons generated by the corona discharge. In the finally remaining organic matters, the hydrophobic group [—CH] is converted into the hydrophilic group [—C=O]. In this corona discharge, a film of metal oxide is formed on the surface of the tube by the oxidizing action of ozone generated from sub-products of the discharge; however, this metal oxide is inactive and porous compared with the single metal, and is not susceptible to the environmental atmosphere. The tube can thus obtain a good hydrophilic property not deteriorated for a long term.

Incidentally, only by corona discharge, there can obtained a heat-transfer surface of a tube having a good hydrophilic property; however, in mass-production, a thick oil film remains on the surface of the heat-transfer tube, or the state of the residual oil is varied, thereby making longer the treating time and causing the unevenness in the treatment effect. To solve this problem, the heating treatment is applied before the treatment by corona discharge, thus making it possible to effectively obtain a heat-transfer tube having a stable hydrophilic property.

The condition of the treatment by corona discharge or plasma discharge is not particularly limited, and may be of course suitably selected.

The present invention will be more clearly understood by way of the following examples.

A phosphorus-deoxidized copper made smoothed tube having an outside diameter of 16 mm and a wall thickness of 0.6 mm was used as a sample (heat-transfer tube). This sample was put in a heating apparatus shown in FIG. 1, and was heated at a heating temperature for a period of time in an atmospheric gas having a specified composition. The copper tube as the sample was fabricated by melting, extrusion, drawing, annealing and drawing. In FIG. 1, numeral 1 designates a heat-transfer pipe; 10 is a heater; 11 is an atmospheric gas inlet; and 12 is a conveyor for carrying the heat-transfer tube.

Figure 4:
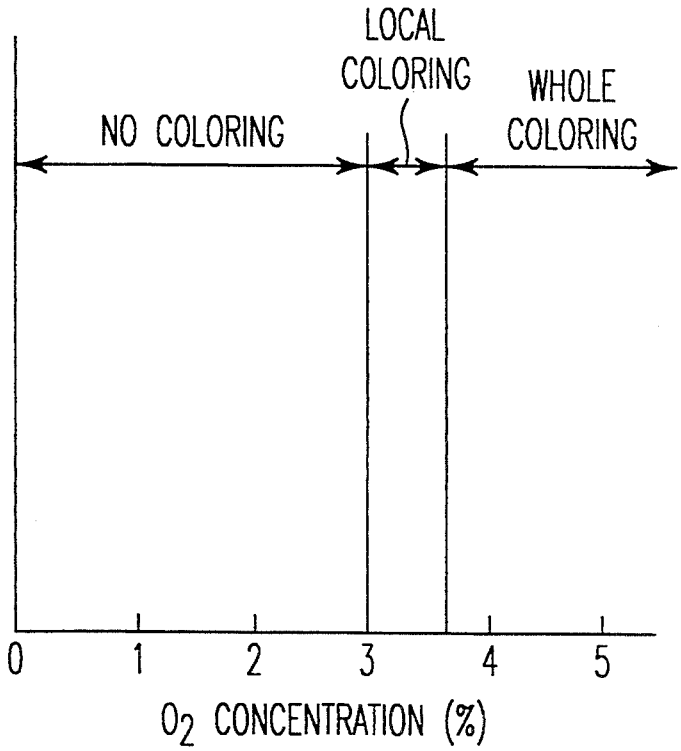
FIG. 4 is a view showing the relationship between the $O_2$ concentration in a heating atmospheric gas and the coloring on a heat-transfer tube.
Figure 5:
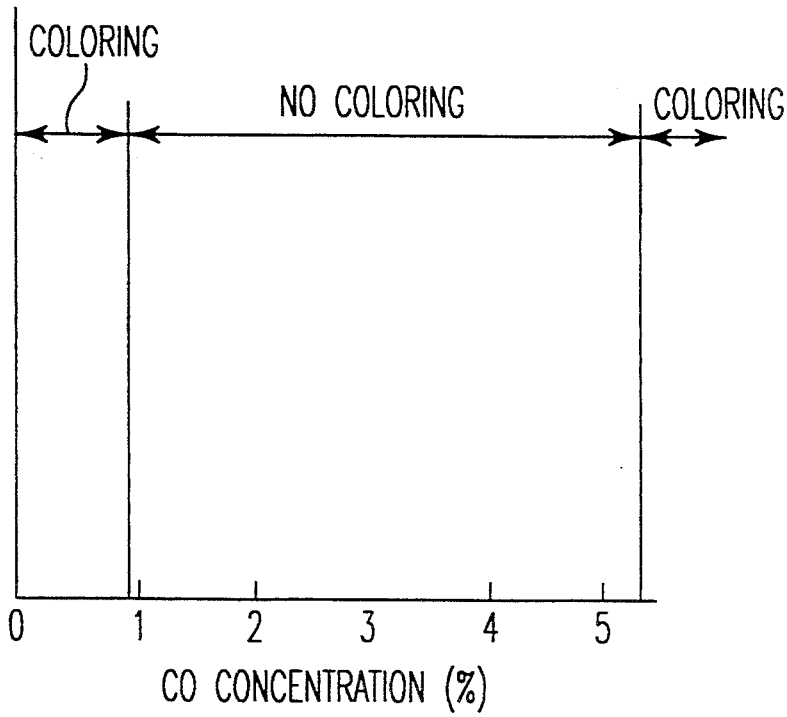
FIG. 5 is a view showing the relationship between the CO concentration in a heating atmospheric gas and the coloring on a heat-transfer tube.

The atmospheric gas contains $O_2$, CO and a trace amount of $H_2$, the balance being $N_2$, wherein the $O_2$ concentration and the CO concentration were changed as shown in FIGS. 4 and 5. As shown in FIG. 4, when the $O_2$ concentration was less than 3%, the coloring was not generated on the heat-transfer tube; when it was in the range from 3 to 3.3%, the coloring was partially generated; and when it was more than 3.5%, the coloring was generated over the whole tube. As for the CO concentration, when it was 0.9% or less and 5.2% or more, the coloring was generated.

The effect of the heating temperature and the heating time in the heating treatment will be described. The change in the tensile strength and the surface residual amount were examined by changing the temperature and heating time. In this experiment, there was used a gas composition containing $O_2$ in a concentration of 1.5%, CO in a concentration of 2.6%, and $H_2$ in a concentration of 1.5%, the balance being $N_2$ gas.

Figure 6:
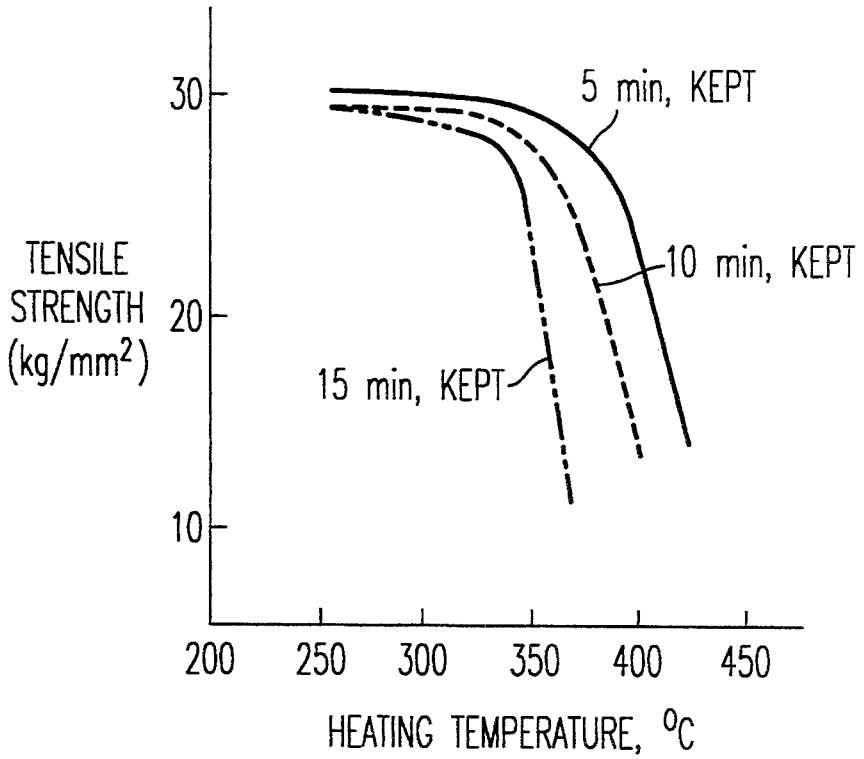
FIG. 6 is a view showing the relationship between a heating temperature and a heating time, and a tensile strength of a heat-transfer tube.
Figure 7:
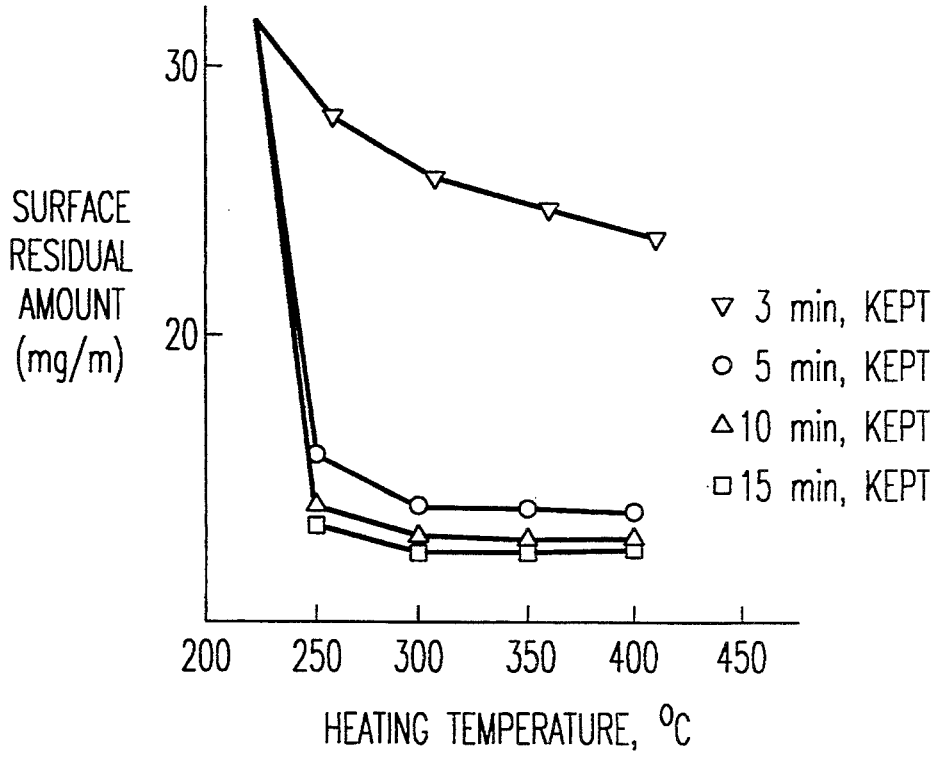
FIG. 7 is a view showing the relationship between a heating temperature and a heating time, and a residual oil amount on the surface of a heat-transfer tube.

As shown in FIGS. 6 and 7, when the heating temperature was less than 250° C., the removing effect of the residual oil was low; while when it was more than 350° C., the tube material was softened. Moreover, even if the heating temperature was in the range from 250° to 350° C., when the heating time was less than 5 min, the removing effect of the residual oil was low; while when it was more than 10 min, the tube material was softened. These results showed that the preferable heating temperature was in the range from 250° to 350° C., and the preferable heating time was in the range from 5 to 10 min.

Next, there will be described the effect of the treatment by corona discharge using a corona discharge apparatus shown in FIGS. 2 and 3 after the heating treatment by a heating apparatus shown in FIG. 1.

Figure 2:
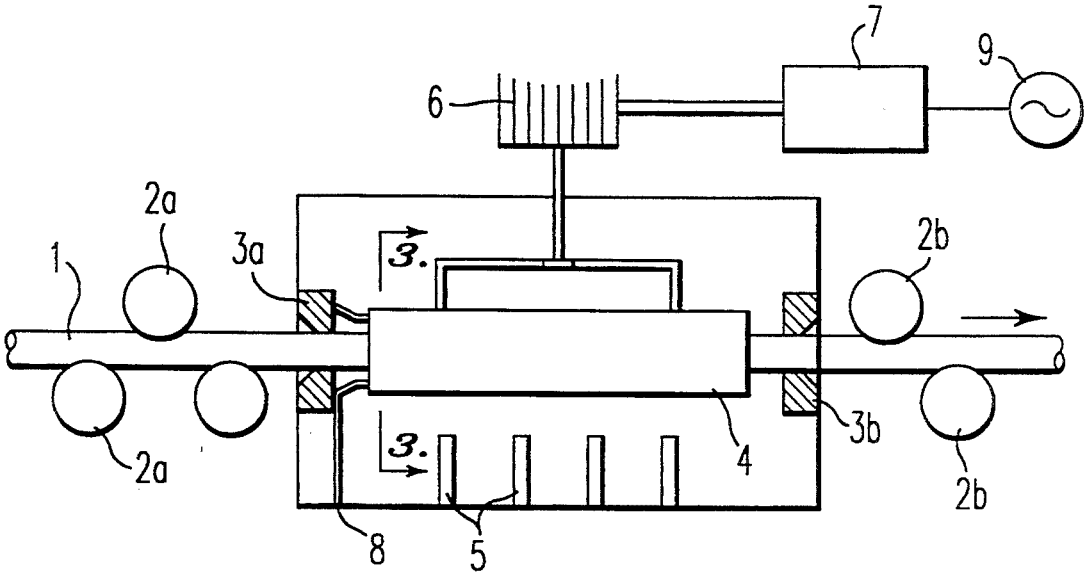
FIG. 2 is a view of assistance in explaining the whole construction of a corona discharge apparatus.
Figure 3:
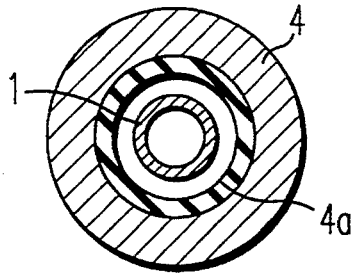
FIG. 3 is a sectional view taken along the line A—A of FIG. 2.

In FIGS. 2 and 3, numerals 2*a* and 2*b* are grounding rolls; 3*a* and 3*b* are guide rolls; 4 is an electrode; 4*a* is an insulator provided on the inner side of the electrode; 5 is an air cooling pipe; 6 is a transformer; 7 is a high frequency generator; 8 is an air cooling tube; and 9 is a power supply.

A heat-transfer tube passes through the corona discharge apparatus so as to be in contact with the grounding rolls while being guided by the guide rolls. A high voltage with a high frequency is applied from the transformer across the outer peripheral surface of the heat-transfer pipe and the cylindrical electrode provided separately therefrom with a specified interval, to generate a corona discharge, thus allowing numerous electrons to collide with the surface of the heat-transfer tube. At this time, oxygen in air is decomposed by the discharge, to generate ozone. The electrode or the treated portion of the heat-transfer tube may be cooled by an air supplied from the air cooling tube.

A phosphorus-deoxidized copper tube having an outside diameter of 16 mm and a wall thickness of 0.6 mm was used as a sample. The copper tube was heated for 8 min at 300° C. in an atmosphere having a gas composition containing $O_2$ in a concentration of 1.5%, CO in a concentration of 2.6%, and $H_2$ in a concentration of 1.5%, the balance being $N_2$ gas.

The copper tube was then put in the corona discharge apparatus shown in FIG. 2. It was made to pass through the electrode with a specified speed of 10 m/min, and was continuously subjected to corona discharge with an output of 1000 W. The residual oil amount on the surface of the tube was measured, and further, the wettability to water was examined using water and a reagent mainly containing ethylene glycol. The results are shown in Table 1.

TABLE 1

Surface Residual Amount and Wettability Factor

| Item | Surface Residual Oil Amount (mg/m) (after one day) | Wettability Factor (dyne/cm) After 1 Day | Wettability Factor (dyne/cm) After 30 Days |
|---|---|---|---|
| Inventive Example 1 | 0.8 | 73 | 73 |
| Inventive Example 2 | 1.0 | 73 | 73 |
| Comparative Example 1 | 10.3 | 33 | 33 |
| Comparative Example 2 | 3.1 | 54 | 33 |
| Comparative Example 3 | 1.2 | 70 | 54 |

In Table 1, Inventive Example 1 is the case where the corona discharge is performed after the heating treatment in an $N_2$ gas atmosphere; and Inventive Example 2 is the case where the corona discharge is performed after the heating treatment in the atmosphere having the gas composition containing $O_2$ in a concentration of 1.5%, CO in a concentration of 2.6%, and $H_2$ in a concentration of 1.5%, the balance being $N_2$ gas. Moreover, Comparative Example 1 is the case where any treatment is not performed; Comparative Example 2 is the case where the heating treatment is performed for 8 min at 300° C. in the atmosphere of the gas composition containing $O_2$ in a concentration of 1.5%, CO in a concentration of 2.6%, and $H_2$ in a concentration of 1.5%, the balance being $N_2$ gas; and Comparative Example 3 is the case where the copper tube was ground by a brush after cleaning by organic solvent. In Table 1, as for the item of the wettability factor, the value in the left column is obtained after an elapse of one day since the treatment; and the value in the right column is obtained after an elapse of 30 days since the treatment.

As is apparent from Table 1, in the tube subjected to the heating treatment and the corona discharge treatment according to the present invention, the residual oil on the surface is small and the wettability factor is large, and further, the hydrophilic property is not deteriorated for a long term compared with the tubes treated by the prior art methods.

Figure 8:
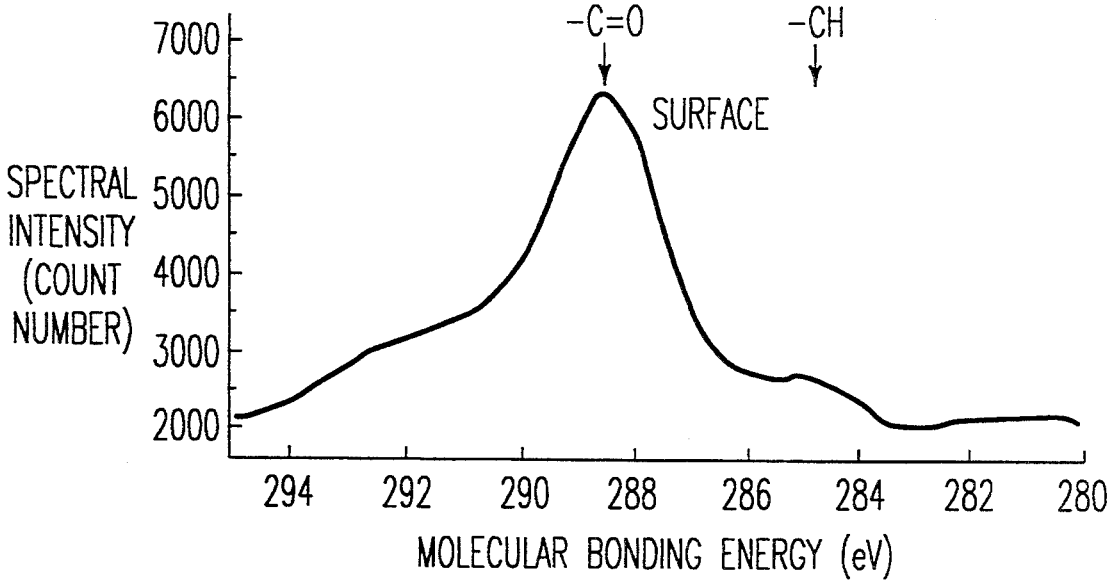
FIG. 8 is a view showing the spectrum of organic matters remaining on the surface of a sample (only corona discharge) according to Inventive Example 2.

As shown in FIG. 8, the spectrum of the X-ray photoelectron spectroscopy (XPS) of organic matters on the surface of the tube according to the present invention has a peak at about 289 eV, which shows that the spectral intensity of the hydrophilic group [−C=O] is larger than that of the hydrophobic group [—CH].

Figure 9:
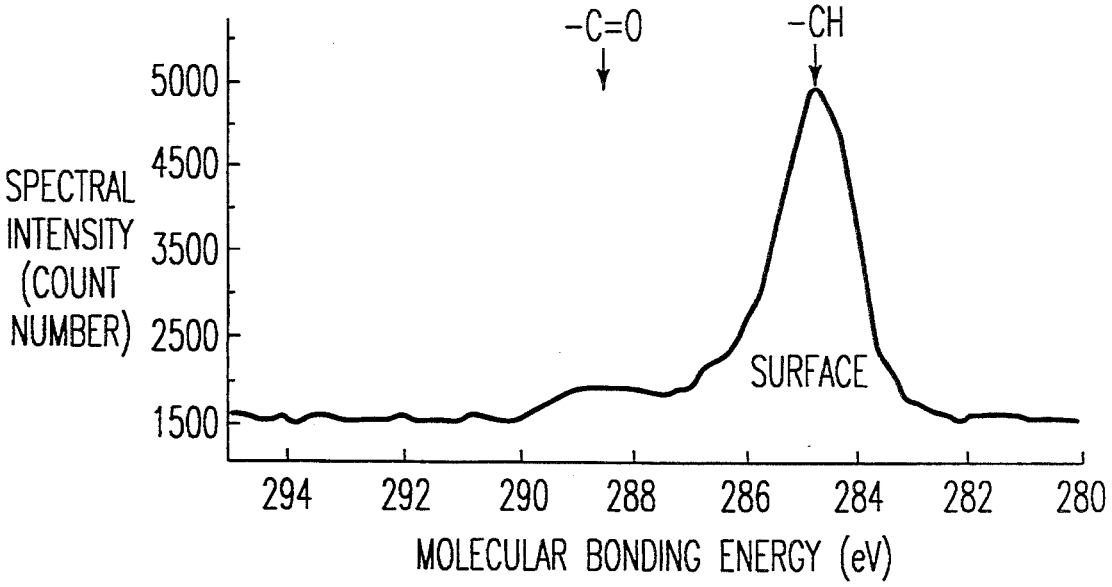
FIG. 9 is a view showing the spectrum of organic matters remaining on the surface of a sample (cleaning+brush-grinding) according to Comparative Example 1.

On the other hand, as shown in FIG. 9, the spectrum of the XPS of organic matters on the surface of the tube according to Comparative Example 3 has a peak at about 285 eV, which shows that the spectral intensity of the hydrophobic group [—CH] is larger than that of the hydrophilic group [—C=O].

Moreover, a film of metal oxide is formed having a film thickness being thicker than that of Comparative Example is formed on the surface of the tube according to the present invention.

The film is changed depending on the condition of the corona discharge. It does not deteriorate the hydrophilic property with age and ensures a good productivity insofar as it is in the range from 300 to 1400 Å.

These results can be confirmed from the difference in the heat-transfer performance. Namely, the higher hydrophilic property shows the higher heat-transfer performance. The evaluation test for the heat transfer performance at the time elapsed by one day directly after the treatment was performed with respect to Inventive Example 1 and Comparative Example 3.

In the evaluation test for the heat-transfer performance, a copper tube already subjected to the above treatments was mounted in an evaporator of an absorption-refrigerator which is of a type of a falling liquid film heat exchanger, and the test was performed at an evaporation temperature of about 4° C., with a cool water flow rate of 1.5 m/s, and with a refrigerant dripping amount ranging from 0.75 to 1.25 kg/(m×min). The results are shown in FIG. 10.

Figure 10:
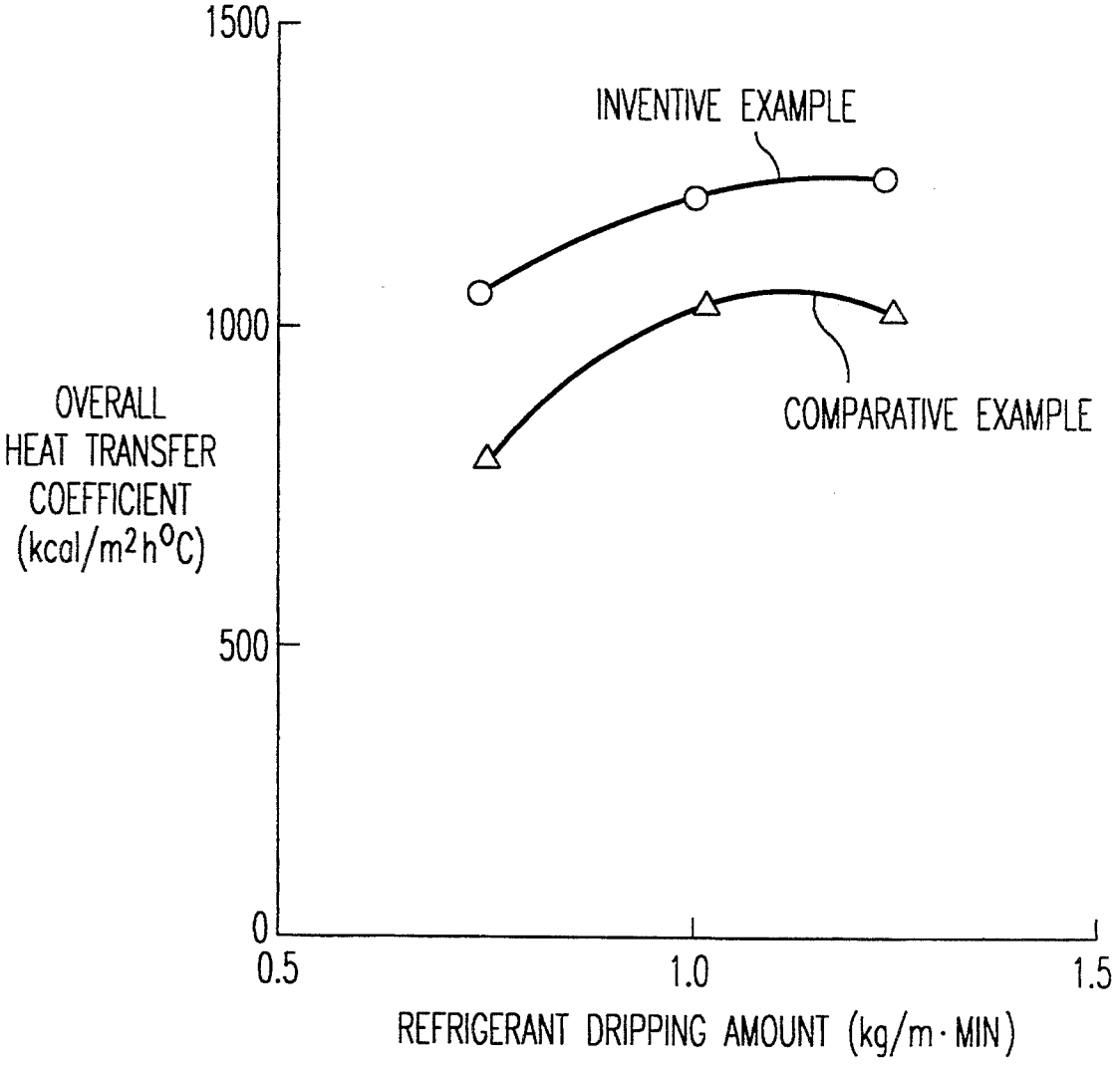
FIG. 10 is a graph showing an evaporative performance of an absorption-refrigerator in which a sample obtained by the inventive example is applied.

As shown in FIG. 10, in the copper tube of Inventive Example 1, the performance is enhanced by about 13% compared with Comparative Example 3. This shows that the material, to which the hydrophilic treatment of the present invention is applied, has the excellent hydrophilic property.

In addition, to obtain the effect of Inventive Examples 1 and 2 only by corona discharge without any heating treatment, the treatment must be performed at a line speed of 5 m/min with a discharge output of 1000 W; however, according to the present invention, the line speed is doubled, that is, 10 m/min, thus extremely enhancing the productivity.

The present invention may be applied not only to the outer surface but also to the inner surface of a tube; and further, may be applied not only to the smoothed surface but also to the corrugated surface.

What is claimed is:

1. A method of applying a surface hydrophilic treatment to a copper or copper alloy heat-transfer tube, comprising the steps of:

heating a copper or copper alloy heat-transfer tube for 5 to 10 minutes at a temperature ranging from 250° to 350° C. in an atmosphere mainly containing an inert gas to separate residual organic matter; and applying corona discharge or plasma discharge to said copper or copper alloy heat-transfer tube to convert hydrophobic groups of any remaining organic matter to hydrophilic groups and to produce an inactive porous copper oxide.

2. A method according to claim 1, wherein said atmosphere contains $O_2$ in a concentration of 3% or less and CO in a concentration of 1 to 5%, the balance being an inert gas.

* * * * *